US006240578B1

(12) United States Patent
Planella

(10) Patent No.: US 6,240,578 B1
(45) Date of Patent: Jun. 5, 2001

(54) SHOWERBATH BASEPLATE

(75) Inventor: Manuel Lagares Planella, Olot (ES)

(73) Assignee: P.V.C. Lagares S. A., Olot (ES)

( * ) Notice: Subject to any disclaimer, the term of this patent is extended or adjusted under 35 U.S.C. 154(b) by 0 days.

(21) Appl. No.: 09/500,233

(22) Filed: Feb. 8, 2000

(30) Foreign Application Priority Data

Jan. 4, 2000 (ES) ..... 200000008 U

(51) Int. Cl.[7] ..... A47K 3/40
(52) U.S. Cl. ..... 4/613; 4/612
(58) Field of Search ..... 4/612, 613, 614

(56) References Cited

U.S. PATENT DOCUMENTS 1,825,355 * 9/1931 Keefe ..... 4/613 X
3,551,918 * 1/1971 Bergmark ..... 4/613

FOREIGN PATENT DOCUMENTS 0774226 5/1997 (EP) .
2562409 4/1984 (FR) .
1590791 6/1981 (GB) .
2108382 5/1985 (GB) .
2306316 5/1997 (GB) .

* cited by examiner

*Primary Examiner*—Robert M. Fetsuga
(74) *Attorney, Agent, or Firm*—Nath & Associates, PLLC; Gary M. Nath; Marvin C. Berkowitz

(57) ABSTRACT

A showerbath base plate having an annular gutter in the form of a ring according to the contour of the showerbath is disclosed. The gutter has an inclined bottom the lowest portion of which is connected to a drainage conduit. Inner and outer walls of the gutter have at their respective upper edges flanges extending horizontally away from the gutter. A flat sheet is supported on the inner wall flanges with an elastic joint therebetween. The flat sheet extends over the gutter to near the flanges of the outer gutter walls with an aperture between the flat sheet and the outer wall flanges.

7 Claims, 6 Drawing Sheets

SHOWERBATH BASEPLATE

Showerbaths are conventionally determined by a baseplate in which the used water from the shower is collected, to be discharged through a drainage gully which is defined in the plate itself and which is connected via a trap to the corresponding sewerage duct.

The plate of the showerbath floor is made of ceramic material, formed in the manner of a tray which is fixedly disposed, secured by masonry work and conjugate with the arrangement of the glazed tiles and square tiles of the walls and floor of the enclosure.

In said disposition, the gully of the showerbath has reduced dimensions, with the result that it is easily blocked, thus potentially giving rise to disadvantages; thus if the trap becomes blocked, access to the same in order to unblock it requires the raising of the plate and makes it necessary to remove glazed tiles of the surrounding tiling, which normally become broken and have to be replaced by new ones, while the plate itself likewise runs the risk of breaking when being unfastened from its mounting.

On the other hand, the gully requires a watertight fastening, which makes the mounting and demounting of the plate even more complicated, a perfect adjustment of said fastening being necessary when mounting, since any maladjustment could give rise to water leaks, with the resulting problems.

In order to remedy these disadvantages, a showerbath plate is proposed according to the present invention, based on a different concept of embodiment, providing very advantageous constructional and functional characteristics.

This showerbath plate which is the subject of the invention consists of a base which can be of stainless steel or glass fiber, and which determines a gutter in the form of a ring according to the peripheral contour of the showerbath, with a bottom inclined laterally toward the interior portion, corresponding to whose lowest portion there goes out a lateral drainage conduit for connecting to the corresponding trap which passes to the sewerage system, while at the upper edge the walls of said gutter determine horizontal flanges extending outwardly away from an interior of said gutter incorporating a flat sheet, supported on the flange of the interior walls, with an intermediate joint and superficially covering the base about as far as the exterior walls of the gutter, a small free aperture being left on the contour with respect to said walls.

There is thus obtained a showerbath plate in which the drainage gully remains defined by the aperture which remains in the contour between the superposed flat sheet and the exterior walls of the base gutter, with which said gully has an extension making obturation by blockage difficult. No other drainage orifice exists in the sheet which determines the surface of the showerbath plate, so that it is aesthetically favorable.

On the other side, no coupling exists of the gully with respect to the surface sheet, so that the latter can be withdrawn by simply raising it, permitting easy access to the gutter for cleaning, and also to the trap for removing an obstruction should this be necessary.

The base gutter is disposed in the application mounting inserted in the corresponding floor, the covering of the adjacent walls and floor being finished on the horizontal flanges of the exterior walls of the gutter, for which purpose said flanges of the exterior walls of the gutter have a turned-up outer edge, by means of which the fastening to the fixing material of the coverings is facilitated.

A completely aesthetic showerbath plate is thus obtained, the base structure of which can be fixedly incorporated into the place of installation, without there being any damage due to the act of opening for access to the interior, in such a manner that cleaning and unblocking, in the case of obstruction, become very easy.

From all of which, said showerbath plate which is the subject of the invention certainly offers very advantageous characteristics, acquiring its own life and character which are preferred over the showerbath plates known at present.

Figure 1:
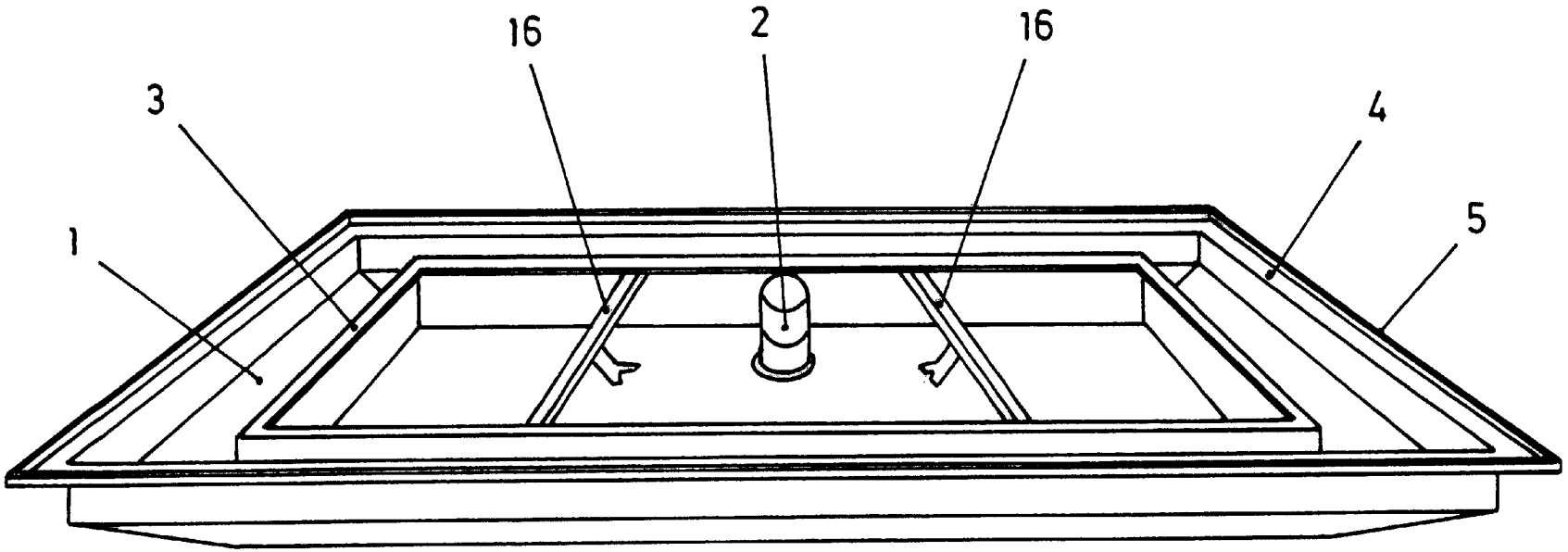
FIG. 1 shows a perspective view of the base gutter of the prior art showerbath plate.
Figure 2:
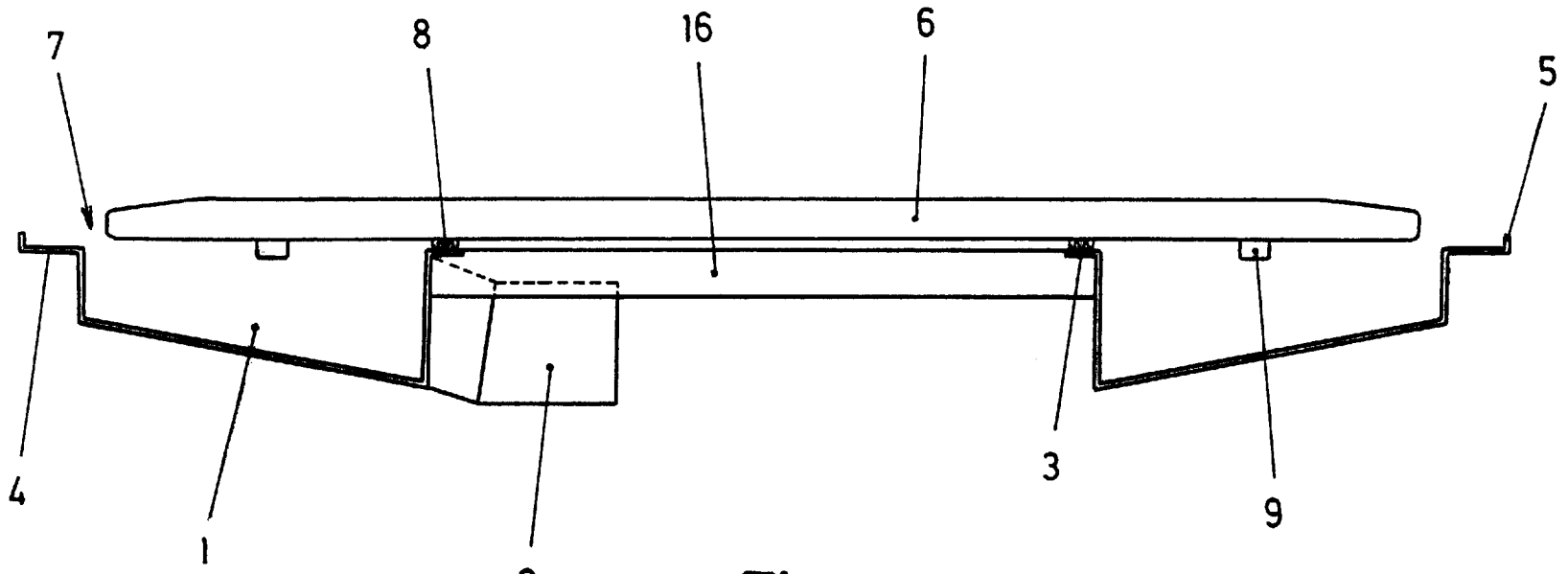
FIG. 2 shows a sectional side elevation view of the assembly of the showerbath plate according to the invention.

The invention relates to a showerbath plate, embodied according to a particular constructional embodiment, providing notable aesthetics, and at the same time solving in a satisfactory manner the problem of opening it for access to the interior portion to carry out cleaning and/or unblocking when necessary.

Said showerbath plate comprises a base, which can be of stainless steel or glass fiber, which determines a gutter (1) which extends to form a rim around the peripheral contour of the showerbath in each case.

This gutter (1) is formed with a bottom which is laterally inclined toward the interior portion, with a lateral drainage duct (2) going out in relation to the lowest portion and intended to be connected to a trap passing to the corresponding sewerage conduit.

The lateral walls of the abovementioned gutter (1) furthermore determine, at the upper edge, respective horizontal outwardly-directed flanges (3) and (4), configured, in the case of the flanges (4) of the exterior walls, with an upturned edge (5).

A sheet (6) which constitutes the platform of the showerbath is supported on the flanges (3) of the interior walls, and superficially covers the base about as far as the exterior walls of the gutter (1), a small free aperture (7) being left with respect to said exterior walls along their whole contour.

In this form, the showerbath plate determines an assembly in which the sheet (6) constitutes the platform for supporting users and for the collection of the water, with the surrounding aperture (7) determining the drainage gully, through which the water passes to the gutter (1), to be furthermore ejected through the duct (2) toward the sewerage conduit.

The support of the sheet (6) on the flanges (3) takes place with the intermediate inclusion of an elastic joint (8), by means of which there are obtained a perfect fitting of the seating, and at the same time a sealed closure on the interior edge of the gutter (1). In order to prevent water escaping underneath the sheet (6) toward the abovementioned support above the flanges (3), a lower rib (9) is included on said sheet (6), and ensures that any water which has escaped falls into the gutter (1) before reaching the support.

Figure 3:
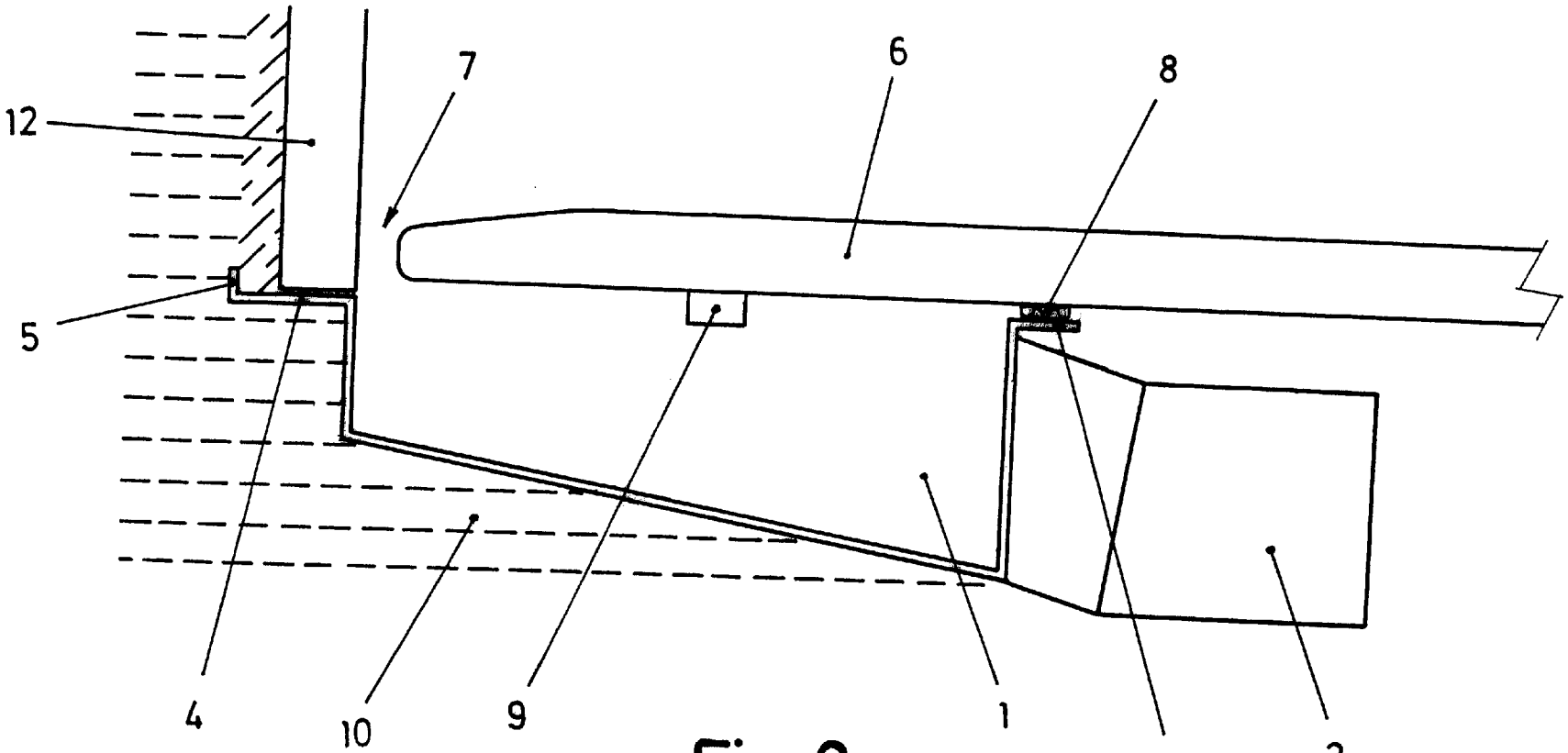
FIG. 3 is an enlarged detail of the disposition of the showerbath plate in the mounting with respect to a wall in the place of application.

In the practical installation, the base of the plate is disposed inserted into the structure of the corresponding floor (10), the flanges (4) of the exterior walls of the gutter (1) being included in the structure of the walls (11) of the enclosure to which they correspond, to finish on said flanges (4) the covering (12) of said walls of the enclosure, as shown in FIG. 3.

Figure 4:
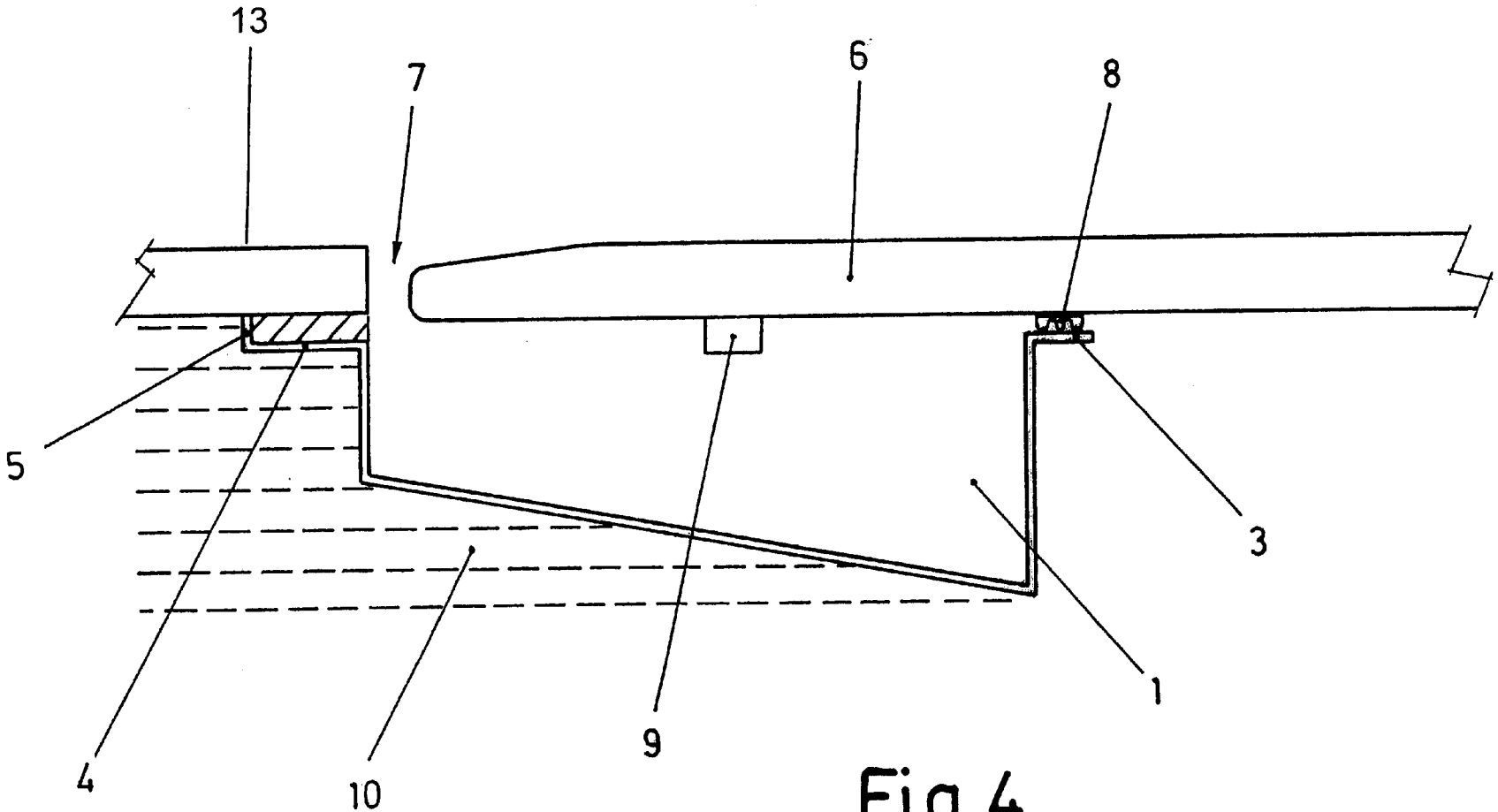
FIG. 4 is an enlarged detail of the disposition of the showerbath plate in the mounting with respect to the adjacent floor in the place of application.

The flanges (4) of the exterior walls of the gutter (1) which do not correspond to walls of the enclosure are in this case included underneath the covering (13) of the surrounding floor (10), as is shown in FIG. 4.

Figure 5:
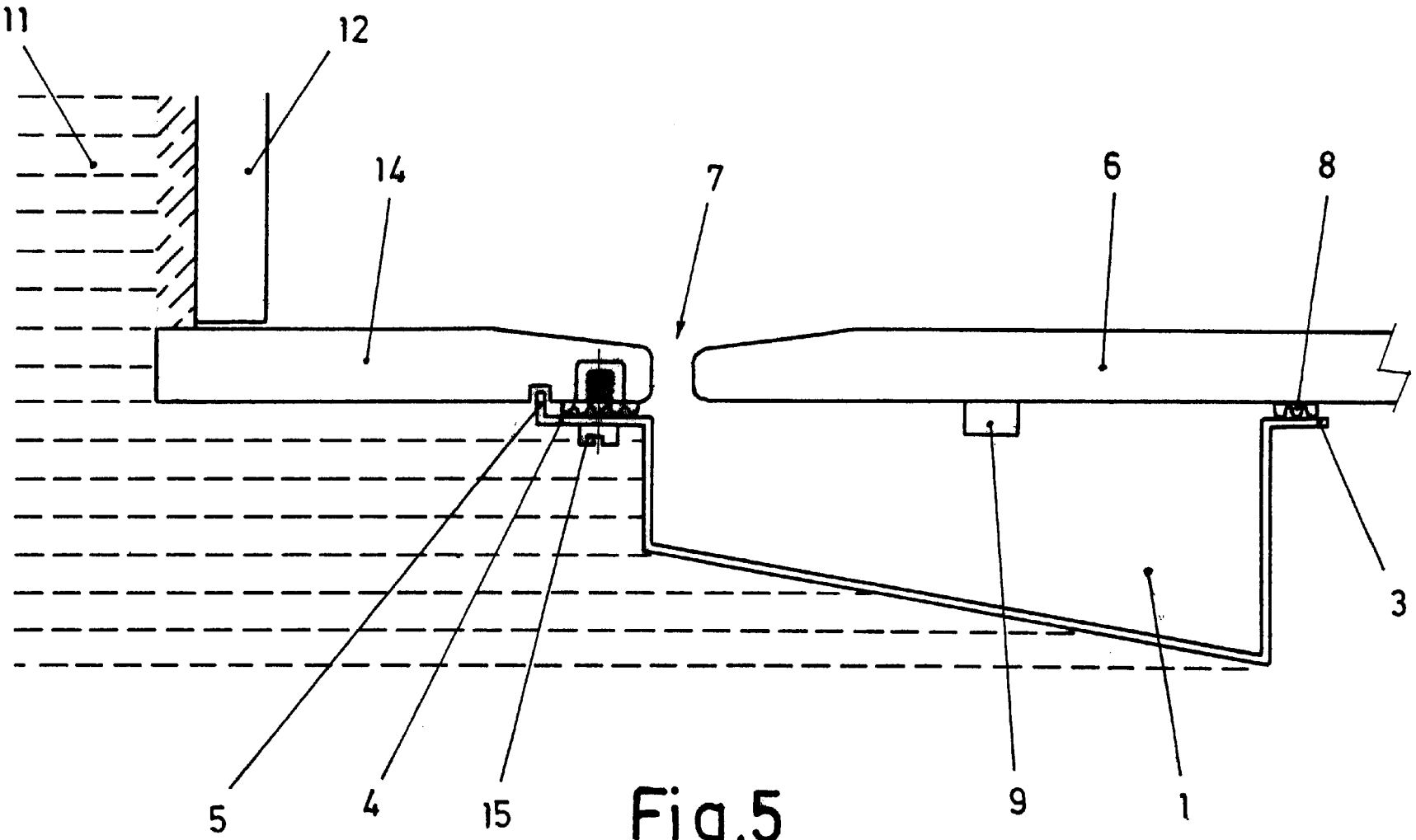
FIG. 5 is an enlarged detail of another practical disposition of the showerbath plate in the mounting, including a ring sheet around it.

In a possible embodiment of the mounting, which does not alter the concept of the proposed plate, a ring (14) in the form of a frame can be incorporated in the circumferential contour of the installation, and can be secured with respect to the exterior flanges (4) of the gutter (1) by means of joining together and fixing with screws (15), as shown in FIG. 5.

The base of the plate, formed by the gutter (1), remains for that reason fixedly disposed in the place of the installation, while the plate (6) determining the platform of the showerbath is disposed simply supported, so that opening it for access to the interior it is only necessary to raise this plate (6), without being obliged to remove anchoring or displace the gutter (1); for this reason, the operation of opening is simple and rapid, and furthermore causes no damage to the installation.

For greater rigidity, reinforcing spars (16) can be included in the interior of the ring determined by the gutter (1), and can in turn serve as support for the sheet (6), thus ensuring the strength of the latter in order to support the weight of the users of the showerbath.

Figure 6:
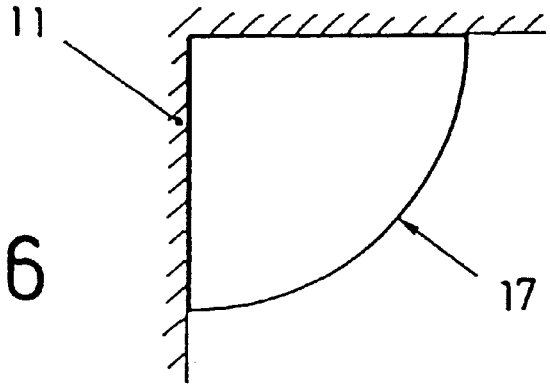
FIGS. 6, 7 and 8 are schematic views of possible configurational examples of the installed showerbath plate.
Figure 7:
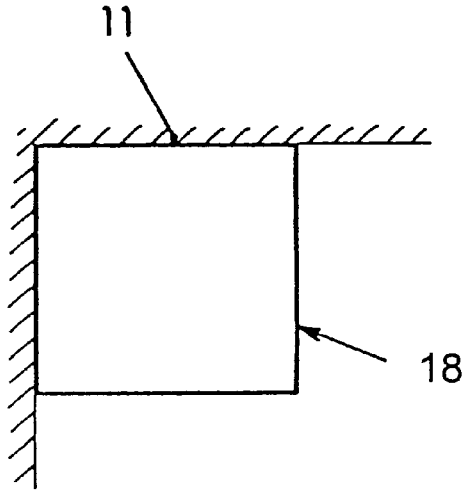
Figure 8:
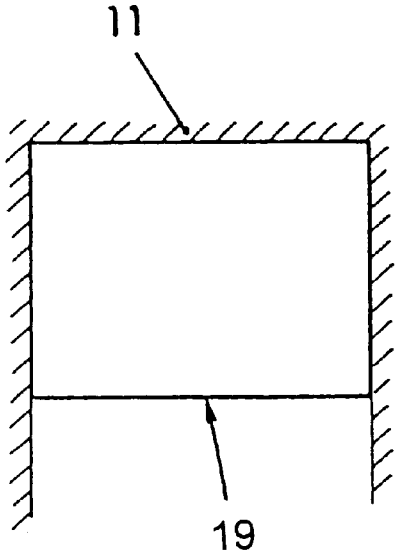

With all the indicated structural characteristics, the proposed showerbath plate can take on any configuration corresponding to different embodiments of the showerbath in its installation, for example, according to a rounded disposition (17) for incorporation in corners between walls (11), as shown in FIG. 6, or according to a quadrangular disposition (18), again enclosed in corners between walls (11), as shown in FIG. 7, or according to a rectangular disposition (19) for incorporation encompassed by walls (11), as shown in FIG. 8; these being only a few practical examples which have no limitative character.

What is claimed is:

1. Improved showerbath plate, characterized in that it comprises:

a base of stainless steel or glass fiber, which defines a gutter having interior and exterior walls, said gutter is extended in the form of a ring according to the contour of the showerbath, said gutter having a laterally inclined bottom with a lowest portion;

a lateral drainage conduit in fluid communication with the lowest portion of said gutter;

said interior and exterior walls of said gutter having at their respective upper edges flanges extending horizontally outwardly away from an interior of said gutter;

a flat sheet is supported on the flanges of the interior walls with the intermediate inclusion of an elastic joint and superficially covering the base about as far as the exterior walls of the gutter; and a small free aperture being left between a perimeter of said flat sheet and said exterior walls on the whole contour.

2. Improved showerbath plate according to claim 1, characterized in that the gutter is disposed inserted into a corresponding floor structure, the flanges of the exterior walls of the gutter being included underneath a covering of the surrounding floor, or else in relation to the structure of walls of an enclosure with which they correspond, in order for a covering of said enclosure walls to terminate over the respective flanges.

3. Improved showerbath plate according to claim 1, characterized in that the sheet is disposed supported on the flanges of the interior walls of the gutter and determines a platform of the showerbath, while the surrounding aperture determines a gully for the passage of water evacuated toward the gutter.

4. Improved showerbath plate according to claim 1, characterized in that a ring is incorporated around the base in the manner of a frame, which can be secured with respect to the exterior flanges of the gutter by means of enclosure and fixing with screws.

5. Improved showerbath plate according to claim 1, characterized in that the flanges of the outer walls of the gutter end in an upturned edge, by means of which the security of the fastening in the mounting is facilitated.

6. Improved showerbath plate according to claim 2, characterized in that the flanges of the outer walls of the gutter end in an upturned edge, by means of which the security of the fastening in the mounting is facilitated.

7. Improved showerbath plate according to claim 4, characterized in that the flanges of the outer walls of the gutter end in an upturned edge, by means of which the security of the fastening in the mounting is facilitated.

* * * * *